United States Patent [19]

Murasaki

[11] 4,417,365

[45] Nov. 29, 1983

[54] CLEANING APPARATUS

[75] Inventor: Hiroshi Murasaki, Sakai, Japan

[73] Assignee: Minolta Camera Kabushiki Kaisha, Osaka, Japan

[21] Appl. No.: 371,483

[22] Filed: Apr. 23, 1983

[30] Foreign Application Priority Data

Apr. 30, 1981 [JP] Japan ..... 56-66248

[51] Int. Cl.[3] ..... D01H 11/00

[52] U.S. Cl. ..... 15/256.51; 118/652; 355/15

[58] Field of Search ..... 15/256.5, 256.51, 256.52; 355/15; 118/652; 198/497

[56] References Cited

U.S. PATENT DOCUMENTS

| | | | |
|---|---|---|---|
| 3,781,107 | 12/1973 | Ruhland . | |
| 3,859,691 | 1/1975 | Katayama et al. . | |
| 4,133,073 | 1/1979 | Marzoli | 15/256.51 X |
| 4,158,498 | 1/1979 | Ohmori . | |
| 4,265,705 | 5/1981 | Pyykkönen | 15/256.51 X |
| 4,281,434 | 8/1981 | Sullivan | 15/256.51 |

FOREIGN PATENT DOCUMENTS 53-150231 11/1978 Japan .

*Primary Examiner*—Chris K. Moore

*Attorney, Agent, or Firm*—Wenderoth Lind & Ponack

[57] ABSTRACT

A cleaning apparatus for cleaning a surface of a member by scraping residual particles off the surface. The apparatus has a blade with a forward edge in pressing contact with the surface, the blade being supported for movement from a position in which it is in pressing contact with the surface of the member to be cleaned to a position in which it is retracted from the surface of the member. A cleaning member for removing particles from the forward edge of the blade when the blade is in the contact position and is supported in pressing contact with the blade in the vicinity of the forward edge on the side of the blade facing the uncleaned area of the surface and on which particles are deposited when the blade is in the contact position in such a way as to cause the cleaning member to move with the blade during the movement of the blade from the contact position to the retracted position and, while remaining in pressing contact with the one side of the blade, to move from the vicinity of the forward edge to the forward edge during the movement of the blade toward the retracted position. Thus as the blade is retracted, the particles deposited on the forward edge of the blade are scraped off by the cleaning member moving in sliding pressing contact with the forward edge.

4 Claims, 4 Drawing Figures

CLEANING APPARATUS

FIELD OF THE INVENTION

The present invention relates to a cleaning apparatus of the blade type generally used for electrophotographic copying machines of the toner image transfer type and the like, and more particularly to a blade type apparatus for cleaning the surface of a member by scraping residual particles off the surface with a blade having a forward edge in pressing contact with the surface.

BACKGROUND AND PRIOR ART

A cleaning apparatus for toner image transfer type electrophotographic copying machines and the like, as seen in FIG. 1*a*, is provided with a blade 2 for scraping toner particles T, which may remain on the surface of a photoconductive drum 1, i.e. the member to be cleaned, after development, from the drum. Most of these particles are allowed to fall away from the drum and then they are recovered. However, when the cleaning apparatus is operated for a prolonged period of time, toner particles T progressively accumulate on the blade 2 at a location close to its forward edge, as illustrated in FIG. 1*a*, and the deposit of accumulated toner particles T is liable to form a solid mass or agglomerate under the influence of ambient conditions (temperature and humidity). Further if a large quantity of residual toner particles T are present at the forward edge of the blade 2, the force from the rotation of the drum 1 and the pressure of the blade 2 in contact therewith will act to agglomerate the toner particles T at the location where the forward edge of the blade is in contact with the drum surface as shown in FIG. 1*b*.

The agglomerates of toner particles T thus formed are likely to engage in the clearance between the blade edge and the drum surface, giving rise to improper cleaning or causing damage to the drum surface. With copying machines wherein the residual toner is reused for development, another problem is encountered, namely that such agglomerates tend to clog up the toner transport system or produce black spots on toner images.

Further if extraneous particles P, such as paper particles, lint or like coarse dust particles, are present on the drum surface along with residual toner particles, these extraneous particles P will gradually accumulate at the location where the forward edge of the blade is in contact with the drum surface, eventually pushing the blade edge locally up out of proper pressing contact with the drum surface, resulting in the problem that the blade fails to scrape off the residual toner completely.

To overcome these problems, a method has been proposed in U.S. Pat. No. 3,859,691 for removing toner particles and extraneous matter from the edge of a blade with a jet of air, and U.S. Pat. No. 4,158,498 discloses a system for removing toner particles from an edge of a blade by a stationary cleaning brush when the blade is moved away from an imaging surface.

However, the former method has the drawback that the cleaning apparatus is large sized and expensive, while the latter system involves the disadvantage that the removed toner will stain the blade again and consequently stain the imaging surface.

Another apparatus has been proposed in U.S. Pat. No. 3,781,107 wherein a blade in the form of an endless belt is revolved so that two segments of the blade are alternately used for cleaning, and when the blade is revolved for changing the segments used for cleaning, toner particles and extraneous matter are removed from an edge of the unused segment by a brush.

This apparatus has the drawback of necessitating a special arrangement for the alternate use of the blade segments.

Still another apparatus has been proposed in Published Unexamined Japanese Utility Model Application No. Sho 53-150231 which includes a rotary brush and a blade both adapted to remove residual toner particles and extraneous matter from the surface of a photoconductive drum and in which the forward edge of the blade is cleaned by the rotary brush.

Although it is free of the drawbacks experienced with the other proposed apparatus, this apparatus has difficulty in completely removing toner particles from the blade edge with the rotary brush because it is difficult for the ends of the bristles of the brush to come into full contact with the blade edge which is in pressing contact with the drum surface or to effectively perform the function of removing toner particles even if they are in contact with the blade edge. The rotary brush is therefore unable to remove the toner particles from the blade edge if they are deposited thereon in the form of agglomerates as described with reference to FIG. 1*b*. Furthermore, the agglomerates of toner particles engaging in the clearance between the blade edge and the drum surface cannot be removed by the rotary brush.

OBJECTS AND BRIEF SUMMARY OF THE INVENTION

The object of the present invention is to provide a cleaning apparatus for removing toner particles and extraneous particles from the forward edge of a blade automatically and effectively merely by moving the blade to a retracted position, which accomplishes this with a simple construction and which does not have the drawbacks of the prior art apparatus.

To fullfill the above object, the invention provides and apparatus for cleaning the surface of a member by scraping residual particles off the surface with a blade having a forward edge in pressing contact with the surface, the apparatus comprising means for movably supporting the blade for movement from a position in which it is in pressing contact with the surface of the member to be cleaned to a retracted position, a cleaning member for removing particles from the forward edge of the blade when it is in the contact position, and means for supporting the cleaning member in pressing contact with the blade in the vicinity of the forward edge of the blade on the one side thereof on which particles are deposited and which faces the uncleaned area of the surface while the blade is in the contact position and for causing the cleaning member to move with the blade while remaining in pressing contact therewith during the movement of the blade from the contact position to the retracted position, the blade supporting means and the cleaning member supporting means being so arranged that the cleaning member is in slidable pressing contact with said one side of the blade from the vicinity of the forward edge to the forward edge during the movement of the blade toward the retracted position, whereby when the blade is retracted, the particles deposited on the forward edge of the blade are scraped off by the cleaning member brought into sliding pressing contact with the forward edge.

Since the cleaning member is in slidable pressing contact with the blade on the side thereof opposed to or facing the uncleaned area of the member to be cleaned, the present apparatus will not stain the surface of the member, unlike the apparatus disclosed in U.S. Pat. No. 4,158,498, yet the amount of movement of the blade can be reduced.

The blade supporting means comprises a blade support member which holds the blade with the above-mentioned one side of the blade at an acute angle to the uncleaned area of the surface of the member to be cleaned, and a pivot for pivotally movably supporting the support member. The cleaning member support means comprises a plate-like resilient member with the cleaning member at its forward end and bent to hold the cleaning member in light pressing contact with the blade in the vicinity of its forward edge on the above-mentioned one side thereof facing the uncleaned area, and a member for supporting the base portion of the plate-like resilient member. Accordingly the cleaning member is kept in slidable pressing contact with the blade by a simple arrangement so that hardly any special space is required for cleaning, whereby the apparatus is compact.

BRIEF DESCRIPTION OF THE DRAWINGS

Other and further objects and advantages will become apparent from the following detailed description, taken with the accompanying drawings, in which.

DETAILED DESCRIPTION OF THE INVENTION

Figure 1A:
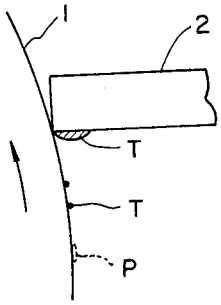
FIGS. 1*a* and 1*b* are elevation views showing toner particles depositing or accumulating on a blade.
Figure 1B:
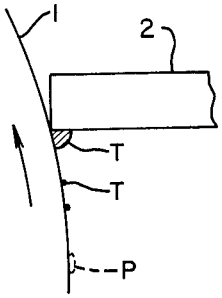
Figure 2:
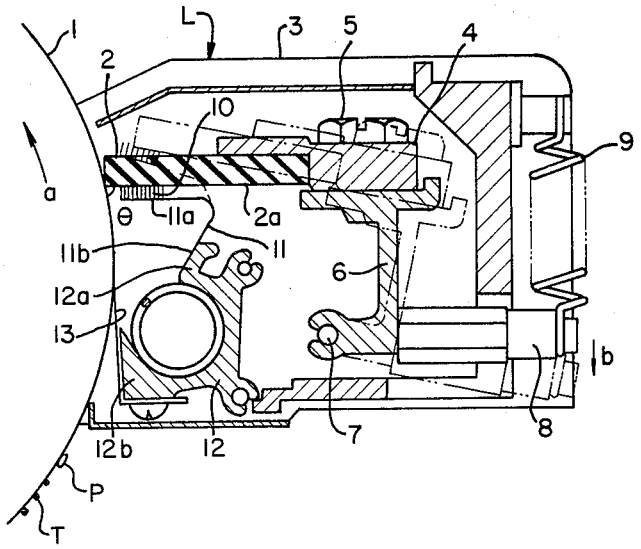
FIG. 2 is a sectional view showing a cleaning apparatus according to the present invention.

FIG. 2 shows the cleaning apparatus according to the invention adapted for use in an electrophotographic copying machine of the toner image transfer type.

A photoconductive drum 1 of the copying machine is driven in the direction of arrow a, and a toner image is formed on the surface of the drum 1 by an unillustrated image forming assembly including a charger, exposure system and developing unit. The toner image is transferred to paper by an unillustrated transfer unit. The drum surface carrying residual toner particles T and extraneous particles P, such as paper particles, lint or like coarse dust particles, is thereafter cleaned by a cleaning apparatus L for scraping these particles off the surface of the drum.

The cleaning apparatus L includes a blade 2 disposed within a housing 3 and in the form of a polyurethane rubber plate, the rubber having a hardness of about 70 to about 90°, and the plate having a thickness of 5 mm and approximately the same length as the drum 1. The blade 2 has a forward edge held in pressing contact with the drum 1 under uniform pressure over the entire length of the drum 1 by a spring 9 to be described later. The side of the blade 2 facing the uncleaned area of the drum surface is at an acute angle $\theta$ of inclination with a tangent to the surface of the drum 1 at the location where the blade edge is pressed against the drum surface. This angle is 85° in the embodiment of FIG. 2.

The blade 2 is supported by a blade holder 4, which is fastened to a support arm 6 by a bolt 5. The support arm 6 is movably supported by a pivot 7 and has a pin 8 thereon projecting outward from the housing 3. The pin 8 is biased counterclockwise in FIG. 2 by the above-mentioned spring 9, whereby the forward edge of the blade 2 is held pressed against the surface of the drum 1 at all times as illustrated.

The pin 8 on the support arm 6 can be pushed manually in the direction of arrow b. Thus the support arm 6 is pivotally movable clockwise by hand against the force of the spring 9 to move the blade edge away from the surface of the drum 1. The support arm 6 is so shaped and the pivot 7 so positioned that the blade edge is movable away from the drum surface to a retracted position indicated in two-dot-and-dash lines in FIG. 2. In the present embodiment, the support arm 6 extends from the blade holder 4 in a direction opposite to the direction of rotation of the drum 1, and the pivot 7 is located within the angle of inclination $\theta$ formed between the uncleaned area of the drum 1 and the blade 2.

A blade cleaning member 10 having the same length as the blade 2 is disposed in pressing contact with the side 2*a* of the blade 2 facing the uncleaned area of the drum surface. The cleaning member 10 used in the present embodiment is a piece of flocked cloth coated, for example, with nylon fibers 0.05 to 0.1 mm in thickness and 1 to 3 mm in length and having a flock density of 5 to 10 fibers/mm$^2$ which is sufficient to prevent passage of toner dust through the flock. Any alternative material, such as rubber, felt or synthetic leather, can be used as long as it is capable of scraping toner particles T from the blade edge.

The cleaning member 10 is attached, for example by an adhesive material such as double-faced tape, to one end 11*a* of a plate-like resilient member 11 made of metal, synthetic resin or the like. The resilient member 11 used for the present embodiment is a polyester film about 0.08 to about 0.15 mm thick. The resilient member 11 is bent as illustrated and has a base portion 11*b* which is attached, for example with a screw or double-faced adhesive tape, to an upper portion 12*a* of a residual toner collecting member 12 provided in a lower portion of the housing 3. The cleaning member 10 on the free end 11*a* of the member 11 is held by the spring force of the plate-like resilient member 11 in light pressing contact with the side 2*a* of the blade 2 in the vicinity of its forward edge while the blade 2 is in contact with the drum 1, is moved with the blade 2 when the blade 2 moves toward its retracted position while remaining in pressing contact therewith, and is brought into light pressing contact with the edge of the blade 2 on the side 2*a* thereof when the blade 2 reaches the retracted position. Thus the plate-like resilient member 11 closes the space between the blade 2 and the toner collecting member 12.

The residual toner collecting member 12 has a lower portion 12*b* opposed to the surface of the drum 1 and provided with a seal member 13 in the form of a thin flexible piece, such as a polyester film. The free end of the seal member 13 bears against the surface of the drum 1. The residual toner particles T and extraneous particles P scraped off the drum 1 by the blade 2 fall under the effect of gravity and are guided to the collecting member 12 by the seal member 13. A rotatably driven spiral roller or like particle transport means is provided in the collecting member 12, whereby the residual toner particles T and extraneous particles P are guided along and suitably discharged from the housing 2.

The support arm 6, which is pivotally movable by hand according to the above embodiment, can be made automatically movable clockwise when the apparatus is not carrying out a cleaning operation to retract the blade 2 from the drum surface.

The cleaning apparatus L having the above described construction operates in the following manner.

While cleaning when the parts are in the illustrated positions, the blade 2 scrapes residual toner particles T and extraneous particles P off the surface of the drum 1, and the removed particles T and P fall under the effect of gravity and are led into the collecting member 12 along the seal member 13.

However, when the cleaning apparatus L is operated for a prolonged period of time, toner particles T and also extraneous particles P will be deposited on and accumulate on the forward edge of the elastic blade 3 and result in a reduced cleaning efficiency.

When this occurs, the pin 8 on the support arm 6 is depressed in the direction of arrow b, whereby the support arm 6, the blade holder 4 and the blade 2 are turned clockwise about the pivot 7 to the retracted position indicated by the two-dot-and-dash lines in FIG. 2. With this movement, the cleaning member 10 in pressing contact with the side 2*a* of the blade in the vicinity of its forward edge also moves while remaining in contact therewith under the spring action of the plate-like resilient member 11. The cleaning member 10 moves upward, while the blade 2 moves away from the surface of the drum 1 at this time, so that the cleaning member 10 slides on the blade surface 2*a* from the vicinity of the forward edge to the forward edge. Consequently the toner particles T and extraneous particles P are automatically scraped off the blade edge toward the drum 1 before agglomerating or adhering to the blade. The removed particles T and P are guided by the seal member 13 into the residual toner collecting member 12 and transported out of the housing 3.

Figure 3:
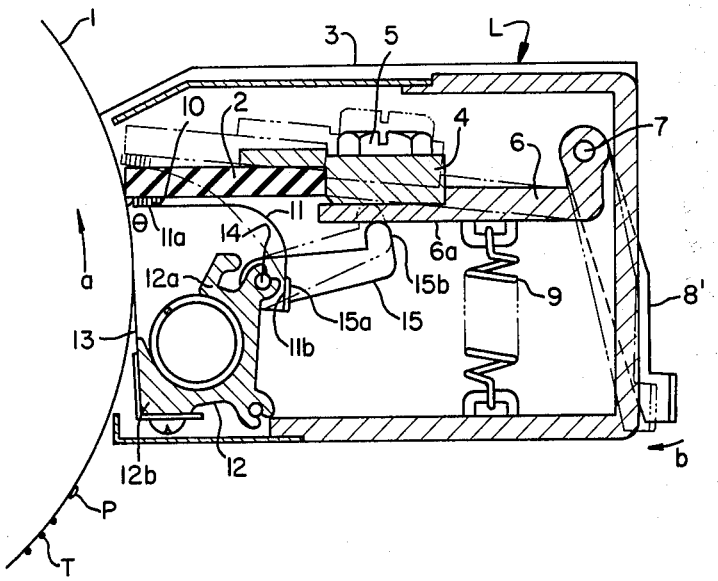
FIG. 3 is a sectional view showing another embodiment of the invention.

FIG. 3 shows another embodiment of the invention also adapted for use in an electrophotographic copying machine of the toner image transfer type.

This embodiment differs from the embodiment shown in FIG. 2 in the manner in which the forward edge of the blade is retracted and the manner in which the cleaning member is caused to move. Throughout FIG. 3, parts similar to those in FIG. 2 are referred to by like reference numerals and characters.

As illustrated, a support arm 6 parallel with the blade 2 is supported by a pivot 7 disposed at an upper part of the housing 3. The support arm 6 is biased counterclockwise by a spring 9. A manual lever 8' pivotally movable with the support arm 6 is mounted on the pivot 7 outside the housing 3.

A plate-like resilient member 11 is fixed to the base portion 15*a* of a lever 15 which is pivoted on a pin 14 on an upper portion 12*a* of a residual toner collecting member 12. The resilient member 11 is provided with a cleaning member 10 on the free end thereof and is bent in a shape to hold the cleaning member 10 in light pressing contact with one side 2*a* of the blade 2 in the vicinity of the forward edge of the blade. The lever 15 is biased counterclockwise around the pin 14 by the spring action of the resilient member 11 and has a free end 15*b* bearing against the bottom surface 6*a* of the support arm 6 at all times. To remove toner particles T and extraneous particles P from the forward edge of the blade 2, the manual lever 8' is pushed in the direction of arrow b and support arm 6 is pivotally moved clockwise about the pivot 7 against the force of the spring 9, thereby moving the blade edge away from a photoconductive drum 1 upward to a position indicated in two-dot-and-dash lines in FIG. 3. The cleaning member 10 moves with the blade during this movement, remaining in pressing contact with the blade surface 2*a* under the spring action of the plate-like resilient member 11. The spring force of the resilient member 11 also turns the lever 15 counterclockwise about the pin 14 during the upward movement of the support arm 6, so that the base portion 11*b* of the resilient member 11 moves upward, and its forward end 11*a* is moved toward the drum surface. Consequently, the cleaning member 10 slides on the blade surface 2*a* while remaining in pressing contact therewith from the vicinity of the blade edge to the edge, whereby the toner particles T and extraneous particles P on the edge of the blade 2 are automatically scraped off in the direction toward the drum 1. With the exception of the above feature, the second embodiment is similar to the first.

In each of the above described embodiments, the blade 2, cleaning member 10, plate-like resilient member 11, residual toner collecting member 12 and seal member 13 define a closed space for cleaning. This assures the advantage of eliminating the likelihood that the toner particles T and extraneous particles P scraped off the drum surface by the blade edge will stain the interior of the housing 3 of the cleaning apparatus L, or adhere to the pivot 7 for the support arm 6, or escape from the housing and stain the interior of the copying machine.

What is claimed is:

1. A cleaning apparatus for cleaning a surface of a member by scraping residual particles off the surface, said apparatus comprising: a blade having a forward edge adapted to be in pressing contact with the surface;

means movably supporting the blade for movement from a position in which it is in pressing contact with the surface of the member to be cleaned to a position in which it is retracted from the surface of the member;

a cleaning member for removing particles from the forward edge of the blade when the blade is in the contact position; and means for supporting said cleaning member in pressing contact with the blade in the vicinity of said forward edge on the side of the blade facing the uncleaned area of the surface and on which particles are deposited when the blade is in the contact position and for causing said cleaning member to move with the blade during the movement of the blade from the contact position to the retracted position and, while remaining in pressing contact with said one side of the blade, to move from the vicinity of said forward edge to said forward edge during the movement of the blade toward the retracted position, whereby when the blade is retracted, the particles deposited on the forward edge of the blade are scraped off by said cleaning member moving in sliding pressing contact with said foward edge.

2. A cleaning apparatus as claimed in claim 1, wherein said blade supporting means comprises a blade support member for, when it is in the contact position, holding said blade with said one side at an acute angle to a tangent to the surface of the member to be cleaned, and a pivot on which said blade support member is pivotally movably supported, and said cleaning member support means comprises a plate-like resilient member having said cleaning member at the forward end thereof and being bent to hold said cleaning member in light pressing contact with the blade in the vicinity of said forward edge on said one side thereof, and a member for supporting the other end of said plate-like resilient member.

3. A cleaning apparatus as claimed in claim 2 wherein said pivot is positioned within an acute angle defined between said one side of said blade and the uncleaned area of the surface of the member to be cleaned for causing said cleaning member to be moved away from the surface of the member to be cleaned when said blade support member pivots toward the retracted position.

4. A cleaning apparatus as claimed in claim 2, wherein said cleaning member support means further comprises a pin on which said supporting member for said plate-like resilient member is movably mounted for causing said cleaning member to be moved toward the surface of the member to be cleaned by the spring force of said plate-like resilient member during the movement of said blade support member toward the retracted position.

* * * * *